US007914396B2

(12) United States Patent
Imamoto et al.

(10) Patent No.: US 7,914,396 B2
(45) Date of Patent: Mar. 29, 2011

(54) GOLF CLUB HEAD

(75) Inventors: Yasunori Imamoto, Tokyo (JP); Hisashi Yamagishi, Tokyo (JP); Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 34 days.

(21) Appl. No.: 11/299,938

(22) Filed: Dec. 13, 2005

(65) Prior Publication Data

US 2006/0128502 A1 Jun. 15, 2006

(30) Foreign Application Priority Data

Dec. 13, 2004 (JP) ..... P2004-359795

(51) Int. Cl.
*A63B 53/04* (2006.01)

(52) U.S. Cl. ..... 473/342; 473/345

(58) Field of Classification Search ..... 473/324–350
See application file for complete search history.

(56) References Cited

U.S. PATENT DOCUMENTS

| | | | | |
|---|---|---|---|---|
| 4,280,700 | A | 7/1981 | Plagenhoef | |
| 5,221,087 | A * | 6/1993 | Fenton et al. | 473/342 |
| 5,346,217 | A | 9/1994 | Tsuchiya et al. | |
| 5,480,153 | A | 1/1996 | Igarashi | |
| 6,254,494 | B1 | 7/2001 | Hasebe et al. | |
| 6,352,482 | B1 | 3/2002 | Jacobson et al. | |
| 6,390,933 | B1 | 5/2002 | Galloway et al. | |
| 6,450,896 | B1 | 9/2002 | Chen | |
| 6,776,726 | B2 * | 8/2004 | Sano | 473/330 |
| 6,994,636 | B2 * | 2/2006 | Hocknell et al. | 473/342 |
| 7,070,512 | B2 | 7/2006 | Nishio | |
| 7,367,899 | B2 | 5/2008 | Rice et al. | |
| 7,785,213 | B2 * | 8/2010 | Matsunaga et al. | 473/342 |
| 2003/0139227 | A1 | 7/2003 | Sugimoto | |
| 2004/0077431 | A1 | 4/2004 | Rice | |
| 2004/0162156 | A1 | 8/2004 | Kohno | |
| 2004/0176181 | A1 | 9/2004 | Meyer et al. | |
| 2004/0192467 | A1 * | 9/2004 | Hocknell et al. | 473/345 |
| 2007/0066420 | A1 | 3/2007 | Imamoto et al. | |

FOREIGN PATENT DOCUMENTS

| | | | |
|---|---|---|---|
| JP | 04090773 A | * | 3/1992 |
| JP | 4-256764 A | | 9/1992 |
| JP | 10-151229 A | | 6/1998 |
| JP | 11-347155 A | | 12/1999 |

(Continued)

OTHER PUBLICATIONS

Japanese Office Action issued in Application No. 2004-359795, dated Nov. 17, 2010.

(Continued)

*Primary Examiner* — Alvin A Hunter
(74) *Attorney, Agent, or Firm* — Sughrue Mion, PLLC

(57) ABSTRACT

A hollow golf club head includes a head main body having a face opening portion on a face side, and a face member that closes the face opening portion. A part or all of an upper edge of the face opening portion and an upper edge of the face member extends to a crown portion.

23 Claims, 2 Drawing Sheets

FOREIGN PATENT DOCUMENTS

| | | | | |
|---|---|---|---|---|
| JP | 11-347157 | A | | 12/1999 |
| JP | 2001-137396 | A | | 5/2001 |
| JP | 2001-170229 | A | | 6/2001 |
| JP | 2001-259091 | A | | 9/2001 |
| JP | 2001-276283 | A | | 10/2001 |
| JP | 2002-95776 | A | | 4/2002 |
| JP | 2003-052865 | A | | 2/2003 |
| JP | 2004024438 | A | * | 1/2004 |
| JP | 2004129944 | A | * | 4/2004 |
| JP | 2004-267630 | A | | 9/2004 |
| JP | 2005-081050 | A | | 3/2005 |
| WO | WO 2004/052472 | A1 | | 6/2004 |
| WO | 2004/078278 | A1 | | 9/2004 |
| WO | WO 2004/089475 | A3 | | 10/2004 |

OTHER PUBLICATIONS

Japanese Office Action dated Mar. 18, 2010 in Japanese application No. 2004-359795.

* cited by examiner

GOLF CLUB HEAD

BACKGROUND OF THE INVENTION

1. Field of the Invention

The present invention relates to a hollow golf club head.

2. Description of the Related Art

A conventional hollow golf club head includes a head main body 14 having a face opening portion 12 on a face side 10 and a face member 16 for closing the face opening portion 12, as shown in FIGS. 4 and 5 (e.g., refer to JP-A-2001-137396).

The hollow golf club head, particularly the recent hollow golf club head made of titanium alloy, can be further enlarged owing to the improved manufacturing technologies. Owing to the enlargement of the head as well as the deeper center of gravity, the researches for improving the easiness of the head to return at the time of hitting a ball and the easiness of the ball to go up have progressed.

The hollow golf club head as shown in FIGS. 4 and 5 is preferable if the center of gravity position of the head on the face side (point where the actual center of gravity of the golf club head is vertically projected onto the face side) and the center of figure position of the face member are as close as possible, especially if the center of gravity position of the head on the face side and the center of figure position of the face member are coincident, because there is greater deflection of the face member at the time of hitting the ball and the flying distance and the feeling of hitting are improved. The center of figure means a point that corresponds to the point of application when the resultant force is obtained by considering the area of figure as a force. Moreover, the actual center of gravity of the golf club head is located in a hollow portion of the golf club head as indicated by sign G in FIG. 5.

However, since the head has the deeper center of gravity, the head center of gravity position A on the face side is considerable higher than the center of figure position B of the face member, as shown in FIGS. 4 and 5. Thereby, the face member 16 was not sufficiently flexed when hitting a golf ball, so that the flying distance was less sufficient and the feeling of hitting became bad occasionally.

SUMMARY OF THE INVENTION

The invention provides a golf club head in which a face member is fixed to a face opening portion of a head main body, whereby the face member is sufficiently flexed when hitting a golf ball, so that the flying distance and the feeling of hitting are improved.

According to an aspect of the present invention, a hollow golf club head includes a head main body having a face opening portion on a face side, and a face member that closes the face opening portion. A part or all of an upper edge of the face opening portion and an upper edge of the face member extends to a crown portion.

DETAILED DESCRIPTION OF THE INVENTION

Figure 1:
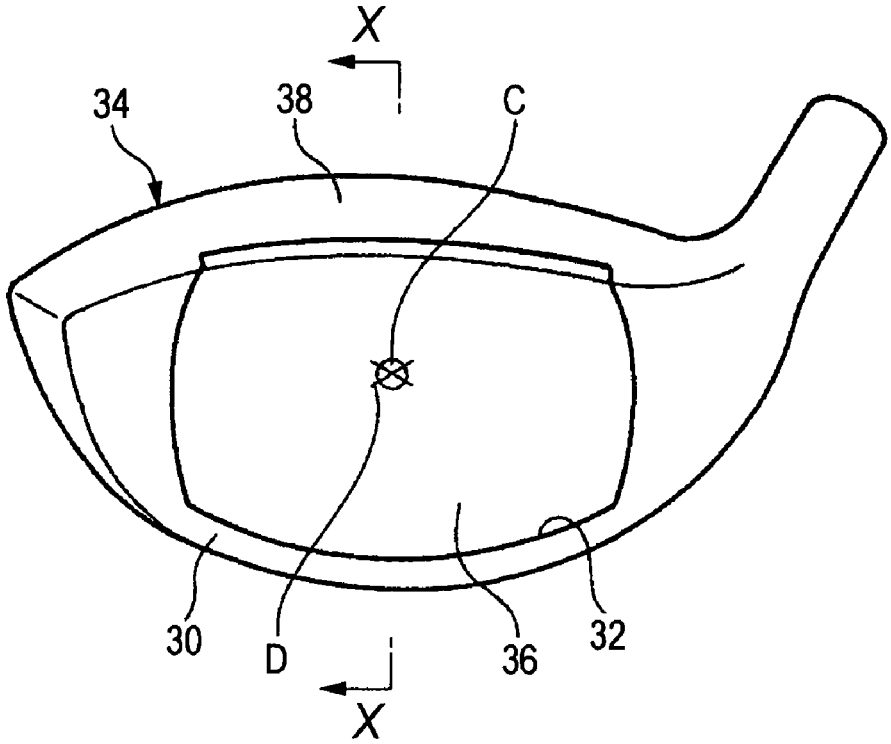
FIG. 1 is a perspective view showing a golf club head according to one embodiment of the present invention.
Figure 2:
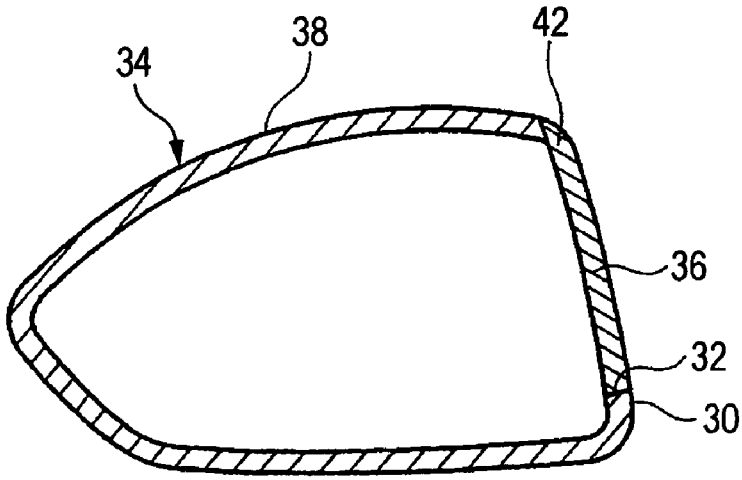
FIG. 2 is an end view of the golf club head of FIG. 1, taken along the line X-X in FIG. 1.
Figure 3:
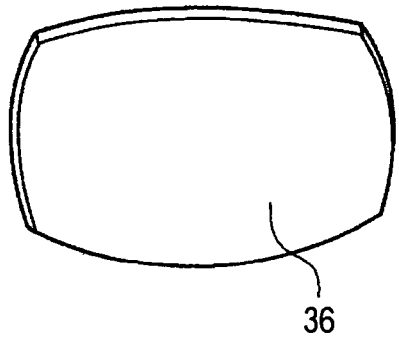
FIG. 3 is a perspective view of a face member of the golf club head of FIG. 1.

The preferred embodiments of the present invention will be described below with reference to the drawings. However, the invention is not limited to the following embodiments. FIG. 1 is a perspective view showing a golf club head according to one embodiment of the present invention. FIG. 2 is an end view of the golf club head of FIG. 1, taken along the line X-X in FIG. 1. FIG. 3 is a perspective view of a face member of the golf club head as shown in FIG. 1.

The golf club head of this embodiment includes a head main body 34 made of titanium alloy (specifically Ti-6Al-4V) having a face opening portion 32 on a face side 30 and a face member 36 made of titanium alloy (specifically SAT2041) for closing the face opening portion 32.

The golf club head of this embodiment has an upper edge of the face opening portion 32 extending to a crown portion 38 and correspondingly has an upper edge of the face member 36 for closing the face opening portion 32 extending to the crown portion 38. Therefore, the center of gravity position C of the head on the face side 30 and the center of figure position D of the face member 36 are coincident. Accordingly, in the golf club head of this embodiment, the face member 36 is sufficiently flexed when hitting a golf ball, so that the flying distance is increased and the feeling of hitting is excellent.

In the invention, the form in which a part or all of the upper edge of the face opening portion and the upper edge of the face member extends to the crown portion is not specifically limited as far as a part or all of the upper edge of the face opening portion is allowed to get into the crown portion of the head main body so that the center of gravity position of the head on the face side and the center of figure position of the face member may be as close as possible, or the center of gravity of the head on the face side and the center of figure position of the face member may be coincident, thereby making a part or all of the upper edge of the face member contact with a part of the crown portion.

In the invention, the head main body may be integrally formed, or formed by joining a plurality of members. Also, the material or molding method of the face member is not specifically limited, but the material is preferably titanium alloy, and the molding method is preferably the integral molding method with casting.

Though the material or molding method of the face member is not specifically limited in this invention, the material is preferably titanium alloy, and the molding method is preferably the press forming method with casting or press working.

The method for joining the head main body and the face member is not specifically limited, but the plasma welding, laser welding or electron beam welding is preferably employed because the juncture part is finished cleanly and the weight precision of the golf club head is enhanced. In this case, the well-known plasma welding may be employed in which the members to be welded are dissolved and resolidified due to high temperature energy caused by plasma arc. Also, the well-known laser welding may be employed in which a gas laser such as CO laser or $CO_2$ laser, or a solid laser such as YAG laser is employed. Also, the well-known electronic beam welding may be employed in which the electron beam of appropriate output is employed. When the plasma arc welding is employed, it is preferred that a filler wire is added between the joined members to provide a weld overlay at the juncture, because the weldability and the welding strength are increased even if the dimensional precision between the welded members is bad.

In the golf club head of the invention, it is particularly effective in improving the flying distance and the feeling of hitting to set the dimensions as follows.

(1) the distance between the center of figure position of the face member and the center of gravity position of the head on the face side is preferably from 0 to 5 mm, particularly from 0 to 3.5 mm.

(2) the depth of the center of gravity is preferably from 30 to 40 mm, particularly from 32 to 35 mm.

(3) the height of face is preferably from 50 to 65 mm, particularly from 55 to 60 mm.

The golf club head of the invention is not limited to the above embodiment, but various modifications may be made thereto without departing from the scope or spirit of the invention. For example, almost all of the upper edge of the face opening portion and the upper edge of the face member extends to the crown portion, but only a part of the upper edge of the face opening portion and the upper edge of the face member may extend to the crown portion.

EXAMPLES

The golf club heads of example 1, example 2 and comparative example were fabricated.

Example 1

A golf club head of the above embodiment as shown in FIGS. 1 to 3 in which the center of gravity position of the head on the face side and the center of figure position of the face member are coincident, and exist 3.8 mm above the vertically central position of the face side.

Example 2

A golf club head of the above embodiment as shown in FIGS. 1 to 3 in which the center of gravity position of the head on the face side and the center of figure position of the face member are coincident, and exist 3.7 mm above the vertically central position of the face side.

Comparative Example

A golf club head of the above embodiment as shown in FIGS. 1 to 3 in which the center of gravity position of the head on the face side and the center of figure position of the face member are not coincident, and the head center of gravity position on the face side exists 3.2 mm above the vertically central position of the face side.

The golf clubs employing the golf club heads of the examples 1, 2 and the comparative example were fabricated, and the professional golfer hit a ball on trial employing these golf clubs. The results are listed in Table 1 below. From the results of Table 1, it can be found that the golf club heads of the invention are enhanced in the flying distance. According to actual hitting data, the hitting points of the number 1 wood by the advanced golfer and the professional golfer were concentrated slightly above the vertically central position of the face side. Therefore, the golf clubs of the invention have the higher effects, especially when the advanced golfer and the professional golfer employ them.

TABLE 1

| | Example 1 | Example 2 | Comparative example |
|---|---|---|---|
| Head speed (m/s) | 51.4 | 51.6 | 51.1 |
| Ball speed (m/s) | 72.9 | 73.6 | 71.5 |
| Meet ratio | 1.417 | 1.428 | 1.398 |
| Carry flying distance (m) | 266.7 | 269.5 | 264.5 |
| Total flying distance (m) | 285.0 | 285.0 | 280.0 |

Figure 4:
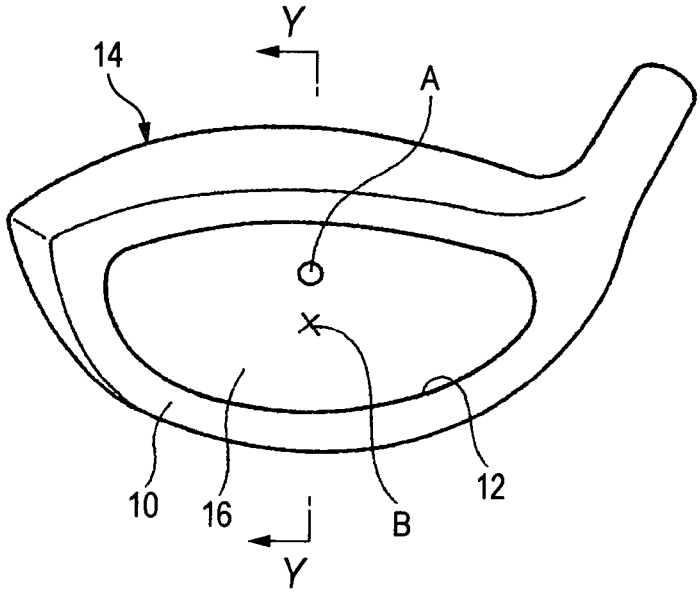
FIG. 4 is a perspective view showing one example of the conventional golf club head.
Figure 5:
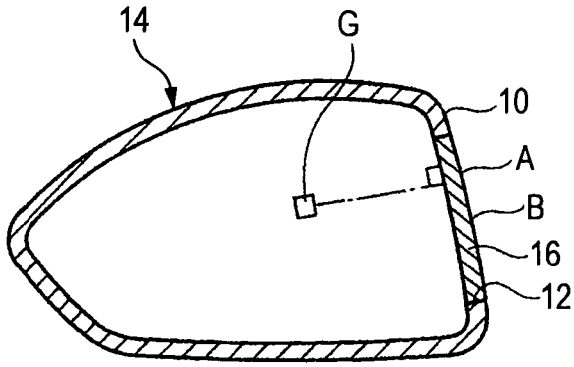
FIG. 5 is an end view of the golf club head of FIG. 4, taken along the line Y-Y in FIG. 1.

In the golf club head of the invention, since a part or all of the upper edge of the face member extends to the crown portion, the center of figure position of the face member is located above that of the golf club head of FIGS. 4 and 5. Therefore, the center of gravity position of the head on the face side and the center of figure position of the face member can be closer than the golf club head of FIGS. 4 and 5, or coincident. Accordingly, in the golf club head of the invention, the face member is sufficiently flexed when hitting a golf ball, so that the flying distance and the feeling of hitting are improved.

In the golf club head of the invention, the face member is sufficiently flexed when hitting a golf ball, whereby the flying distance is increased and the feeling of hitting is excellent.

What is claimed is:

1. A hollow golf club head comprising:

a head main body having a face opening portion on a face side open to an interior of the main body; and a face member that closes the face opening portion and has a back surface, wherein all of an upper edge of the face opening portion contacts with the back surface at a position where the face side intersects a crown portion, wherein a lower edge of the face opening portion is formed on the face side above a portion where the face side intersects a sole portion, and contacts a lower edge of the face member.

2. The golf club head according to claim 1, wherein the head main body is integrally formed by casting.

3. The golf club head according to claim 1, wherein the face member is formed by a casting or press forming method.

4. The golf club head according to claim 1, wherein the head main body and the face member are joined by plasma welding, laser welding or electron beam welding.

5. The golf club head according to claim 1, wherein the distance between the center of figure position of the face member and the center of gravity position of the head as projected on the face side in a direction perpendicular to the face side is from 0 to 3.5 mm.

6. The golf club head according to claim 1, wherein a height of the face member ranges from 50 mm to 65 mm.

7. A hollow club head comprising:

a head main body having a face opening portion on a face side open to an interior of the main body; and a face member that closes the face opening portion and has a back surface, wherein all of an upper edge of the face opening portion and contacts with the back surface at a position where the face side intersects a crown portion, wherein at least a part of an end portion of the crown contacts a back surface of the face member, wherein a lower edge of the face opening portion is formed on the face side and contacts a lower edge of the face member.

8. The golf club head according to claim 7, wherein a back surface of the face member only contacts an end portion of the crown portion.

9. The golf club head according to claim 7, wherein the head main body is integrally formed by casting.

10. The golf club head according to claim 7, wherein the face member is formed by a casting or press forming method.

11. The golf club head according to claim 7, wherein the head main body and the face member are joined by plasma welding, laser welding or electron beam welding.

12. The golf club head according to claim 7, wherein the distance between the center of figure position of the face member and the center of gravity position of the head as projected on the face side in a direction perpendicular to the face side is from 0 to 3.5 mm.

13. The golf club head according to claim 7, wherein a height of the face member ranges from 50 mm to 65 mm.

14. The golf club head according to claim 7, wherein the face side includes a face.

15. The golf club head according to claim 14, wherein the face opening portion is on the face.

16. A hollow golf club head comprising:

a head main body having a face opening portion on a face side open to an interior of the main body; and a face member that closes the face opening portion and has a back surface, wherein all of an upper edge of the face opening portion contacts with the flat back surface at a position where the face side intersects a crown portion, wherein the back surface of the face member only contacts an end portion of the crown portion, wherein a lower edge of the face opening portion is formed on the face side and contacts a lower edge of the face member.

17. The golf club head according to claim 16, wherein edges of the face member other than the upper edge of the face member contact the face opening portion.

18. The golf club head according to claim 16, wherein the head main body is integrally formed by casting.

19. The golf club head according to claim 16, wherein the face member is formed by a casting or press forming method.

20. The golf club head according to claim 16, wherein the head main body and the face member are joined by plasma welding, laser welding or electron beam welding.

21. The golf club head according to claim 16, wherein the distance between the center of figure position of the face member and the center of gravity position of the head as projected on the face side in a direction perpendicular to the face side is from 0 to 3.5 mm.

22. The golf club head according to claim 16, wherein the face side includes a face.

23. The golf club head according to claim 22, wherein the face opening portion is on the face.

* * * * *